US010186820B1

(12) United States Patent
Gellert et al.

(10) Patent No.: US 10,186,820 B1
(45) Date of Patent: Jan. 22, 2019

(54) ELECTRICAL CONNECTION DEVICE

(71) Applicant: Architectural busSTRUT Corporation, Worthington, OH (US)

(72) Inventors: Larry Gellert, New Albany, OH (US); Greg Gellert, Columbus, OH (US); Denver Clark, Columbus, OH (US); Daryl Van Mercetta, Columbus, OH (US)

(73) Assignee: Architectural busSTRUT Corporation, Worthington, OH (US)

( * ) Notice: Subject to any disclaimer, the term of this patent is extended or adjusted under 35 U.S.C. 154(b) by 0 days.

(21) Appl. No.: 15/986,394

(22) Filed: May 22, 2018

Related U.S. Application Data

(63) Continuation-in-part of application No. 15/803,745, filed on Nov. 4, 2017.

(51) Int. Cl.
*H01R 25/14* (2006.01)
*H01R 13/22* (2006.01)
*H01R 13/631* (2006.01)

(52) U.S. Cl.
CPC ..... *H01R 25/142* (2013.01); *H01R 13/22* (2013.01); *H01R 13/631* (2013.01); *H01R 25/145* (2013.01)

(58) Field of Classification Search
CPC .... H01R 25/142; H01R 13/22; H01R 13/632; H01R 25/145
USPC ..... 439/115, 116
See application file for complete search history.

(56) References Cited

U.S. PATENT DOCUMENTS 3,391,377 A * 7/1968 Corl ..... F21V 21/34 439/116
3,489,981 A * 1/1970 Corl ..... H01R 25/14 174/99 B
3,529,274 A * 9/1970 Routh ..... H01R 25/14 439/118
3,718,816 A * 2/1973 Seelbach ..... F21V 21/35 174/99 B
4,655,520 A * 4/1987 Cummings ..... F21V 21/002 439/111
5,092,787 A 3/1992 Wise et al.
(Continued)

*Primary Examiner* — Harshad C Patel
(74) *Attorney, Agent, or Firm* — Benesch, Friedlander, Coplan & Aronoff LLP

(57) ABSTRACT

A housing structure has an upper section, a lower section, and an intermediate wall. The intermediate wall has a wire aperture. The upper section has a top wall with contactor slots. An upper compartment is enclosed vertically between the top wall and the intermediate wall. The lower section has a bottom wall with a wire aperture. A lower compartment is enclosed vertically between the bottom wall and the intermediate wall. An electrical contactor has a blade portion projecting outward from the upper compartment through a contactor slot for electrical contact with a busbar in a strut. A wire has an uninsulated section that is contained entirely within the upper compartment, and is electrically connected to the contactor within the upper compartment. An insulated section of the wire reaches outward from the upper compartment into the lower compartment through the wire aperture in the intermediate wall. The insulated section of the wire reaches further outward from the lower compartment through a wire aperture in the bottom wall.

26 Claims, 9 Drawing Sheets

(56) References Cited

U.S. PATENT DOCUMENTS

| | | | | |
|---|---|---|---|---|
| 6,024,583 | A * | 2/2000 | Hauselt | H01R 4/2404 439/505 |
| 6,517,363 | B2 * | 2/2003 | Ross | H01R 25/14 439/115 |
| 6,805,226 | B1 | 10/2004 | Ross et al. | |
| 7,520,763 | B1 * | 4/2009 | Buse | H01R 25/142 439/121 |
| 2002/0064980 | A1 * | 5/2002 | Zhu | H01R 25/145 439/115 |

* cited by examiner

ELECTRICAL CONNECTION DEVICE

RELATED APPLICATIONS

This application is a continuation-in-part of U.S. patent application Ser. No. 15/803,745, filed Nov. 4, 2017, which is incorporated by reference in its entirety.

TECHNICAL FIELD

This technology includes electrical contactors for interconnecting with busbars in a busway.

BACKGROUND

Electrical bus systems are often used to provide electrical power to lighting fixtures, security systems, receptacles, and the like. In an overhead installation, a bus system may include busways suspended from a ceiling. An individual busway typically includes an elongated strut for routing electrical wires, known as busbars, through the busway. The strut may be configured as a channel with an open bottom along its length. The open bottom of the channel provides access to the busbars. An electrical device, such as a fitting or joiner, may be mounted on the strut to interconnect with the busbars at a selected location along the length of the busway.

SUMMARY

An apparatus is configured for use with a busway that includes a strut containing busbars. In a given example, the apparatus includes a housing structure having an intermediate wall, an upper section, and a lower section.

The intermediate wall has a wire aperture. The upper housing section has a top wall with contactor slots. An upper compartment is enclosed vertically between the top wall and the intermediate wall. The lower housing section has a bottom wall with a wire aperture. A lower compartment is enclosed vertically between the bottom wall and the intermediate wall.

An electrical contactor has a blade portion projecting outward from the upper compartment through a contactor slot for electrical contact with a busbar in the strut. A wire has an uninsulated section that is contained entirely within the upper compartment. The uninsulated section of the wire is electrically connected to the contactor. An insulated section of the wire reaches outward from the upper compartment into the lower compartment through the wire aperture in the intermediate wall. The insulated section of the wire reaches further outward from the lower compartment through a wire aperture in the bottom wall.

Summarized differently, an apparatus includes a housing with a base wall having a wire aperture, a top wall having contactor slots, and a compartment enclosed between the base wall and the top wall. A wire has an uninsulated section contained entirely within the compartment. The wire also has an insulated section reaching outward from the compartment through the wire aperture in the base wall. An electrical contactor has a blade portion projecting outward from the compartment through a contactor slot for electrical contact with a busbar in the strut. Another portion of the contactor is crimped directly onto the uninsulated section of the wire within the compartment.

Other features of the apparatus are provided for electrical clearance and creepage protection. In the given example, a pair of electrical contactors have adjacent blades. Each blade projects outward from a housing compartment through a contactor slot for electrical contact with a busbar in the strut. Each blade also has an edge that reaches over a base wall in the housing compartment. The housing includes a blockage wall that is interposed between the adjacent contactor blades. The blockage wall has a closed juncture with the base wall. The closed juncture helps to block electric current from passing over the base wall in a direction reaching directly between the adjacent blade sections.

DETAILED DESCRIPTION

Figure 1:
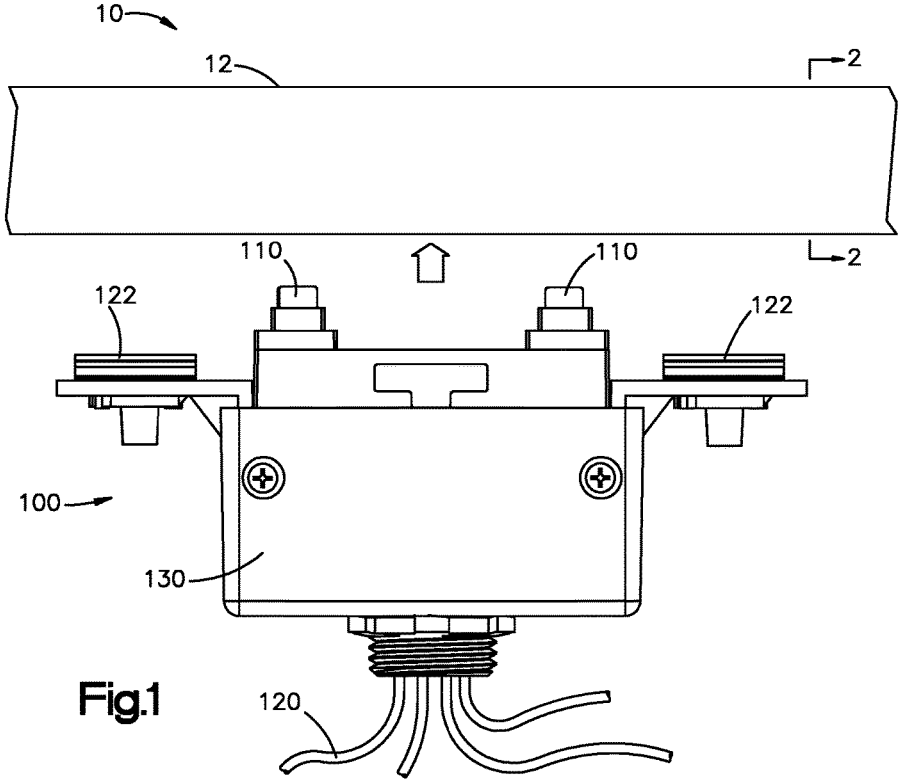
FIG. 1 is a side view of a busway and an electrical fitting for use with the busway.

The apparatus illustrated in the drawings includes parts that are examples of the elements recited in the claims. The illustrated apparatus thus includes examples of how a person of ordinary skill in the art can make and use the claimed invention. These examples are described to meet the enablement and best mode requirements of the patent statute without imposing limitations that are not recited in the claims. One or more elements of one embodiment may be used in combination with, or as a substitute for, one or more elements of another as needed for any particular implementation of the invention.

The apparatus shown in FIG. 1 includes an electrical power distribution track 10 known as a busway. In the side view of FIG. 1, the busway 10 is oriented horizontally in an overhead position that the busway 10 would take when suspended from a ceiling. Also shown in FIG. 1 is an electrical device 100 for use with the busway 10. The device 100 in this example is a fitting for electrically interconnecting a light fixture or other electrical load device to the busway at a selected location along the length of the busway 10.

Figure 2:
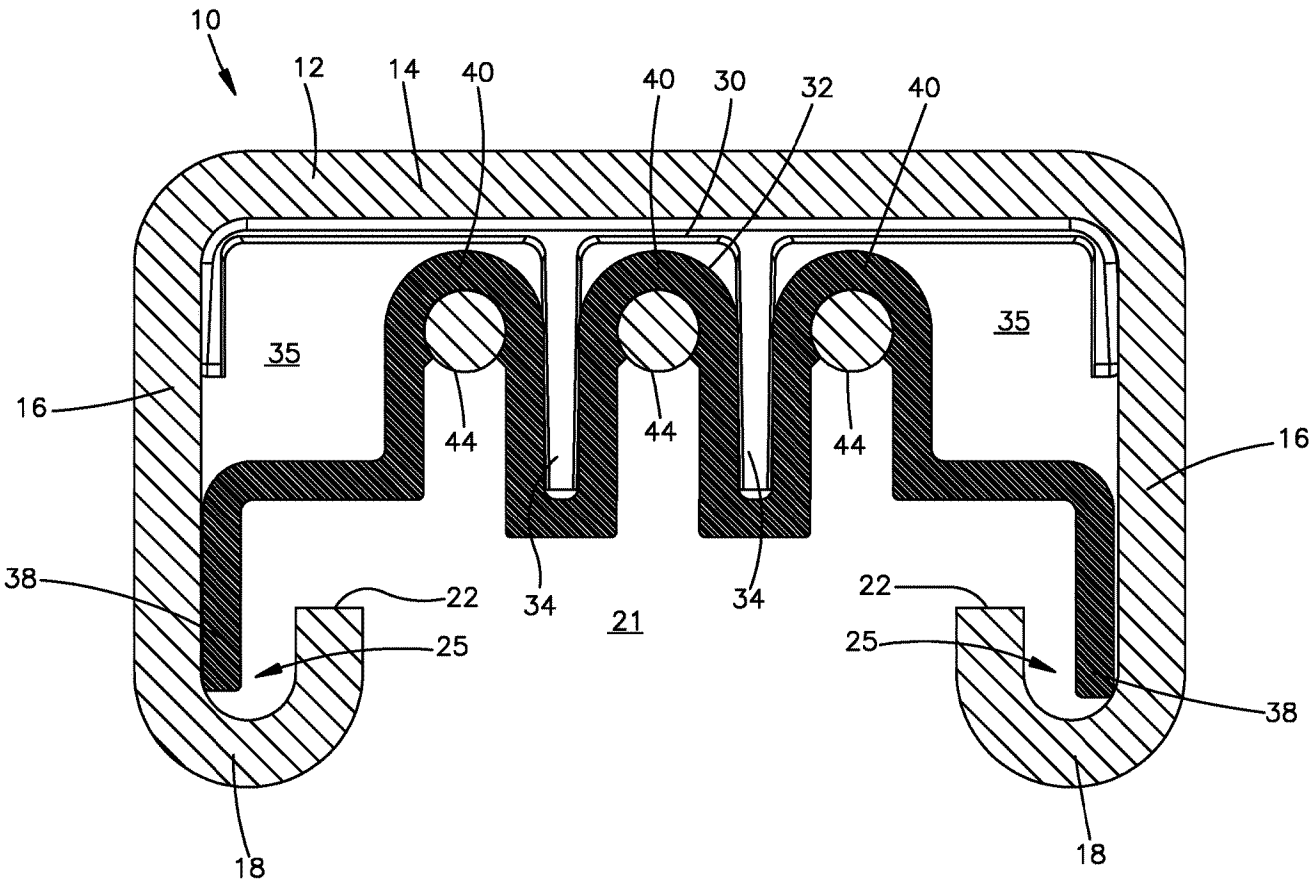
FIG. 2 is a sectional view taken on line 2-2 of FIG. 1.

As shown in the cross-sectional view of FIG. 2, parts of the busway 10 include an elongated strut 12 reaching lengthwise of the busway 10. The strut 12 in the illustrated example has a generally U-shaped cross-section with a top wall 14 and opposite side walls 16. Lower edge portions 18 of the side walls 16 are spaced apart horizontally across the bottom of an open channel 21 in the strut 12. The lower edge portions 18 are turned inward and upward to define ledges 22 and grooves 25 reaching along opposite sides of the channel 21.

Other parts of the illustrated busway 10 include an isolator 30 and an insulator 32. The isolator 30 and the insulator 32 are both formed of electrically nonconductive material, and are both elongated lengthwise of the strut 12. The isolator 30 includes dividers 34 between compartments 35 at the top of the channel 21. The insulator 32 has side walls 38 received in the grooves 25 in the strut 12, and further has troughs 40 nested within the compartments 35. Each trough 40 contains a respective conductor wire 44 known as a busbar. The busbars 44 are accessible from beneath along the open lengths of the troughs 44.

Figure 3:
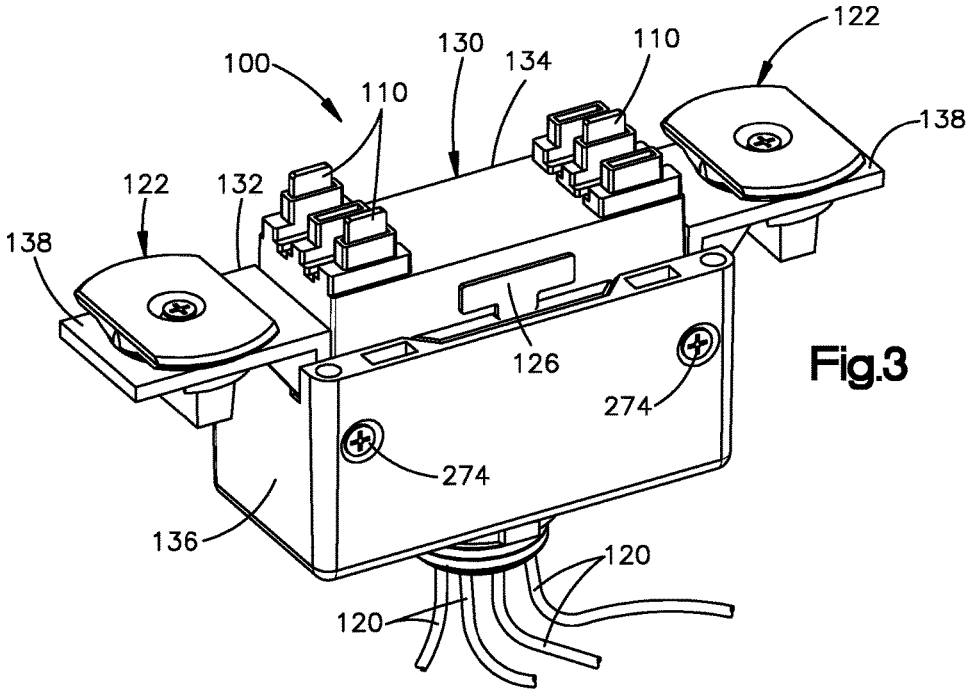
FIG. 3 is a perspective view, taken from above, of the fitting of FIG. 1.
Figure 4:
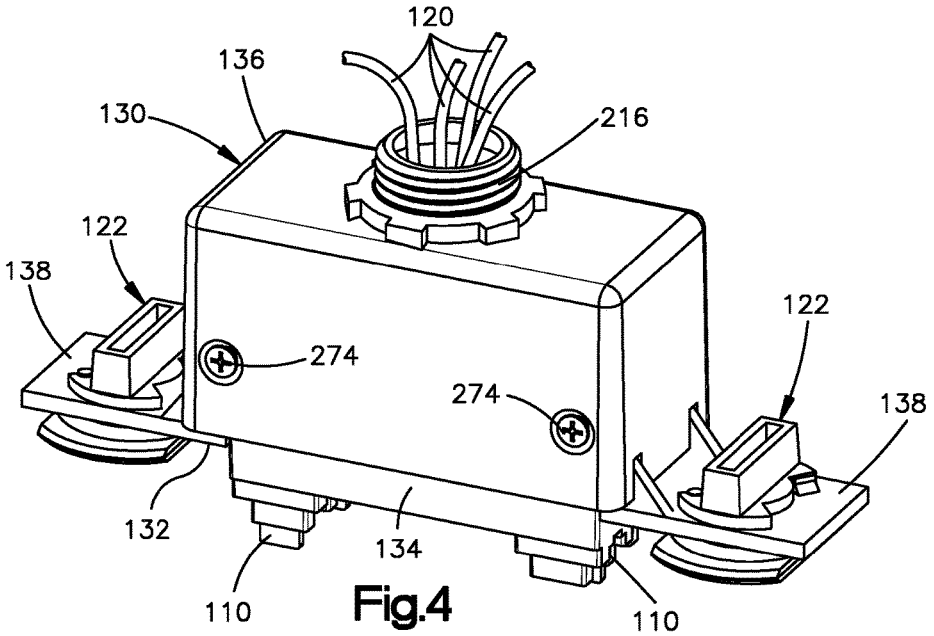
FIG. 4 is a perspective view, taken from below, of the fitting.

As shown in FIGS. 3 and 4, the fitting 100 is configured for use with a busway that includes a strut containing busbars. With reference to the example of a busway 10 shown in FIG. 1, this example of a fitting 100 is configured for electrically connecting a light fixture or other electrical load device to the busbars 44 at a selected location along the length of the strut 12. The fitting 100 thus has electrical contactors 110 protruding from the top of the fitting 100 for contact with the busbars 44. Wires 120 extend outward from the bottom of the fitting 100 for delivering power to the load device. Locking mechanisms 122 are provided for releasably securing the fitting 100 in the channel 21 at the selected location along the length of the strut 12. A ground terminal 126 on the fitting 100 is configured to make grounding contact with the strut 12 at a lower edge portion 18 on one side of the channel 21.

The fitting 100 includes a housing 130. In the given example, the housing 130 has separate parts respectively defining an intermediate section 132, an upper section 134, and a lower section 136. The contactors 110 protrude from the upper housing section 134. The wires 120 extend outward from the lower housing section 136. The locking mechanisms 122 are located on platforms 138 at opposite ends of the intermediate housing section 132.

As shown in greater detail in FIGS. 5-8, the intermediate housing section 132 includes a horizontal base wall 140. Wire apertures 145 extend through the base wall 140 in an array corresponding to the array of busbars to which the fitting 100 will be connected. The base wall 140 in the given example thus has three wire apertures 145 in adjacent positions corresponding to the adjacent positions of the three busbars 44 in the strut 12. The wire apertures 145 are preferably oversized for strain relief in the wires 120. Two pairs of fins 146 project upward from the top surface 147 of the base wall 140 in parallel positions near opposite ends of the base wall 140. Spring holders 148 and fastener apertures 149 also are provided on the base wall 140.

The intermediate housing section 132 further has a pair of opposed side walls 150 reaching upward along opposite sides of the base wall 140. A pair of opposed end walls 152 reach farther upward from the opposite ends of the base wall 140. The locking platforms 138 are configured as wings projecting oppositely outward from the end walls 152.

The locking mechanisms 122 include cams 154 that are manually rotatable into and out of an engaged position projecting laterally from both sides of the respective platform 138, as shown in FIG. 3. The fitting 100 is first lifted into the channel 21 in the strut 12, with the cams 154 spaced apart along the length of the strut 12. The cams 154 are then rotated to the engaged positions. Each cam 154 then reaches across the channel 21, and overlies the adjacent ledges 22 (FIG. 1) at the opposite sides of the channel 21 to support the fitting 100 on the strut 12.

Figure 5:
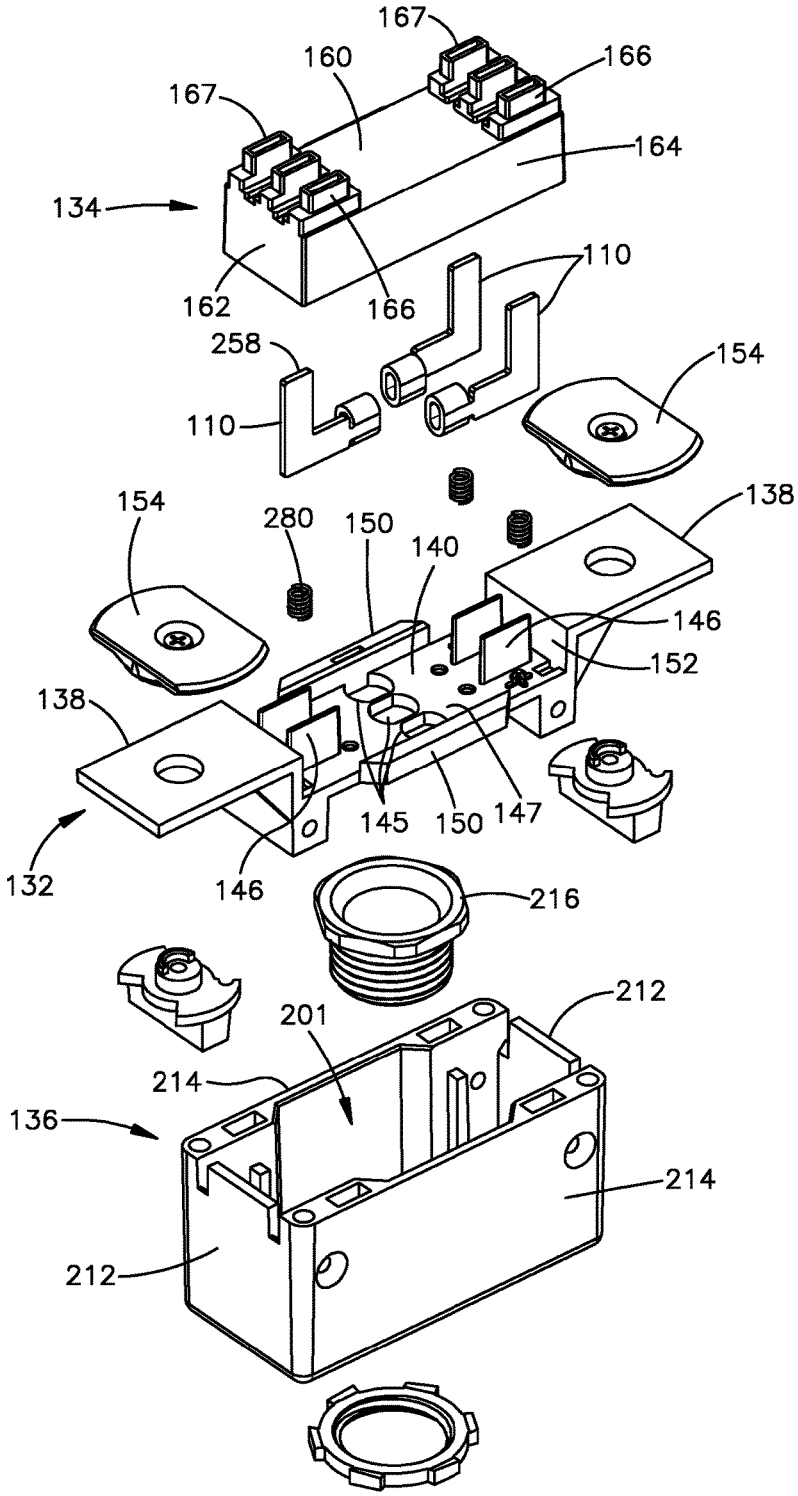
FIG. 5 is an exploded perspective view of the fitting.
Figure 6:
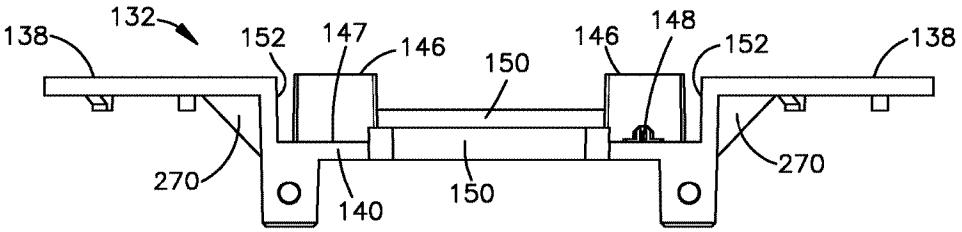
FIG. 6 is a side view of a part shown in FIG. 5.
Figure 7:
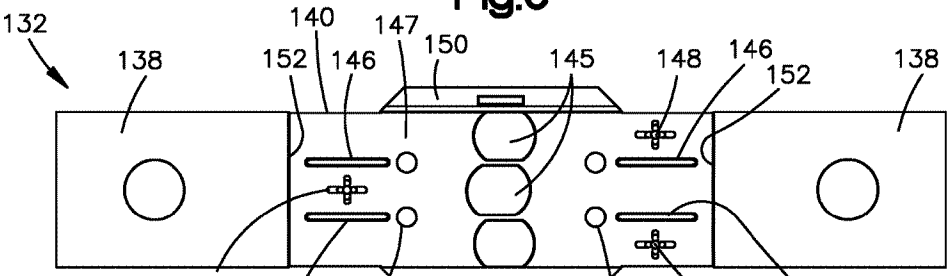
FIG. 7 is a top view of the part shown in FIG. 6.
Figure 8:
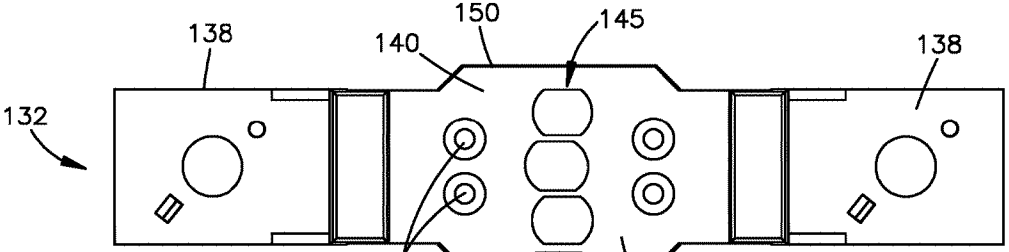
FIG. 8 is a bottom view of the part shown in FIG. 6.
Figure 9:
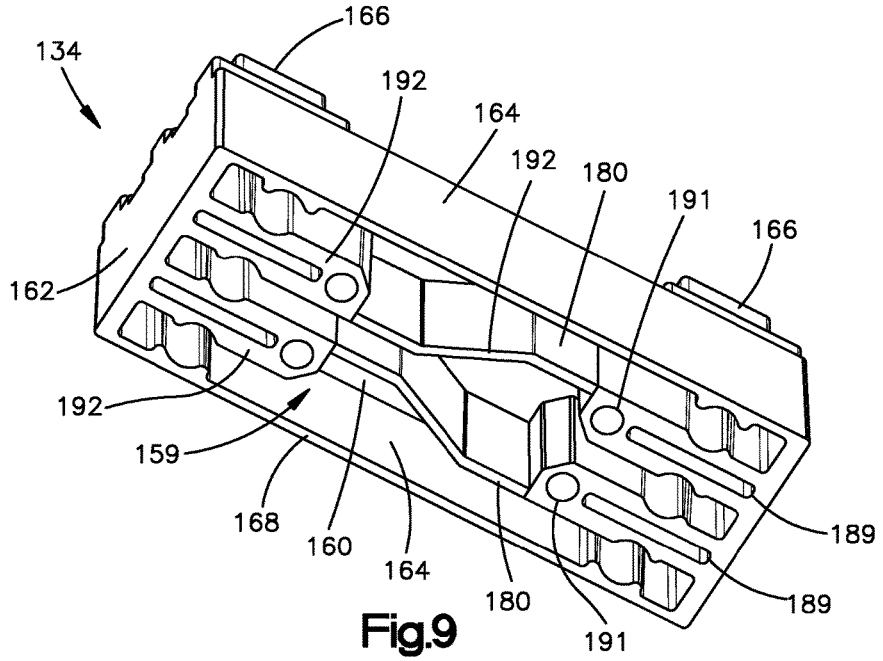
FIG. 9 is a perspective view, taken from below, of a part shown in FIG. 5.
Figure 10:
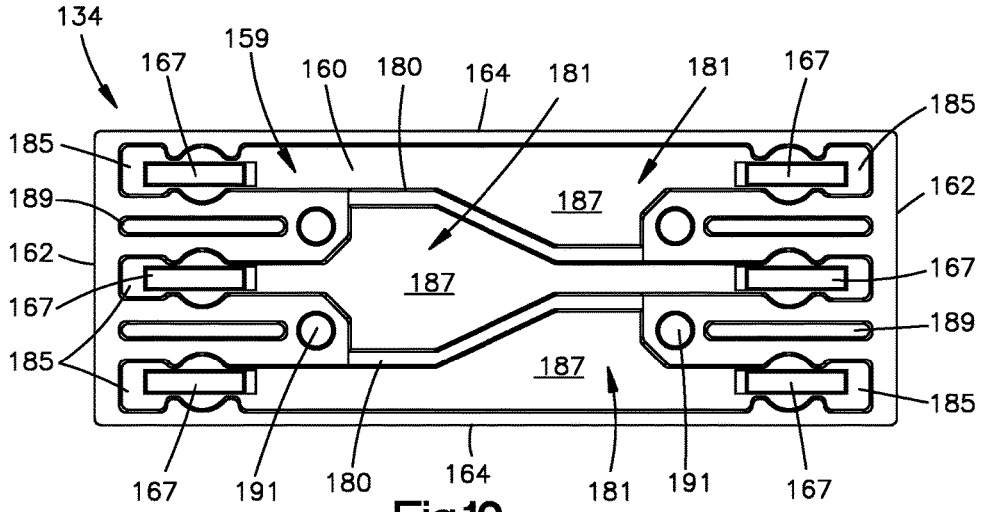
FIG. 10 is bottom view of the part shown in FIG. 9.

The upper housing section 134 has an interior configured as an upper compartment 159 (FIGS. 9 and 10). In the given example, the upper housing section 134 is shaped as a rectangular box with a top wall 160, a pair of upper end walls 162, and a pair of upper side walls 164. The top wall 160 has bosses 166 with slots 167 (FIG. 5). The slots 167 are configured for the contactors 110 to project upward as shown in FIG. 3, and are arranged in three aligned pairs corresponding to the three busbars 44 in the strut 12. The upper end walls 162 and the upper side walls 164 are continuous fully about the periphery of the upper housing section 134, and together define a peripheral lower edge 168. In this configuration, the upper compartment 159 reaches horizontally between the upper end walls 162 and the upper side walls 164. The upper compartment 159 also reaches vertically from the top wall 160 to an open bottom at the peripheral lower edge 168.

As viewed from below in FIGS. 9 and 10, the upper housing section 134 also has internal walls 180. The internal walls 180 divide the upper compartment 159 into elongated chambers 181. Each chamber 181 reaches lengthwise beneath a respective pair of aligned slots 167 in the top wall 160. The internal walls 180 provide each chamber 181 with narrow opposite end regions 185 directly beneath the slots 167. The internal walls 180 further provide each slot 167 with a region 187 having an enlarged width compared to the end regions 185. Fin slots 189 and fastener bores 191 are defined within the internal walls 180. Lower edges 192 of the internal walls 180 are coplanar with the peripheral lower edge 168.

Figure 11:
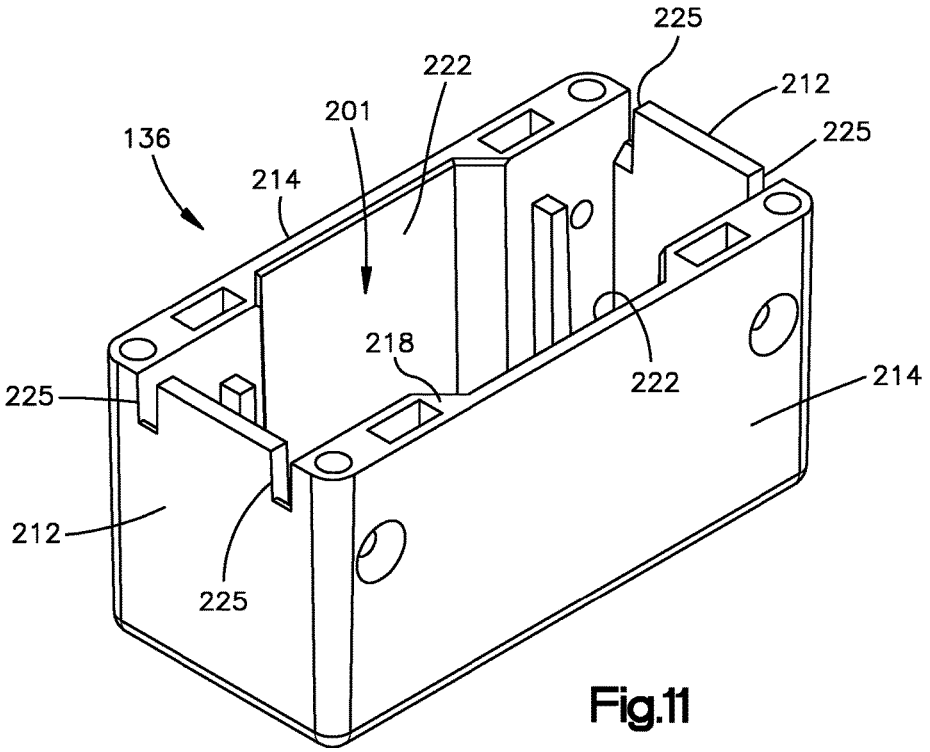
FIG. 11 is a perspective view, taken from above, of another part shown in FIG. 5.
Figure 12:
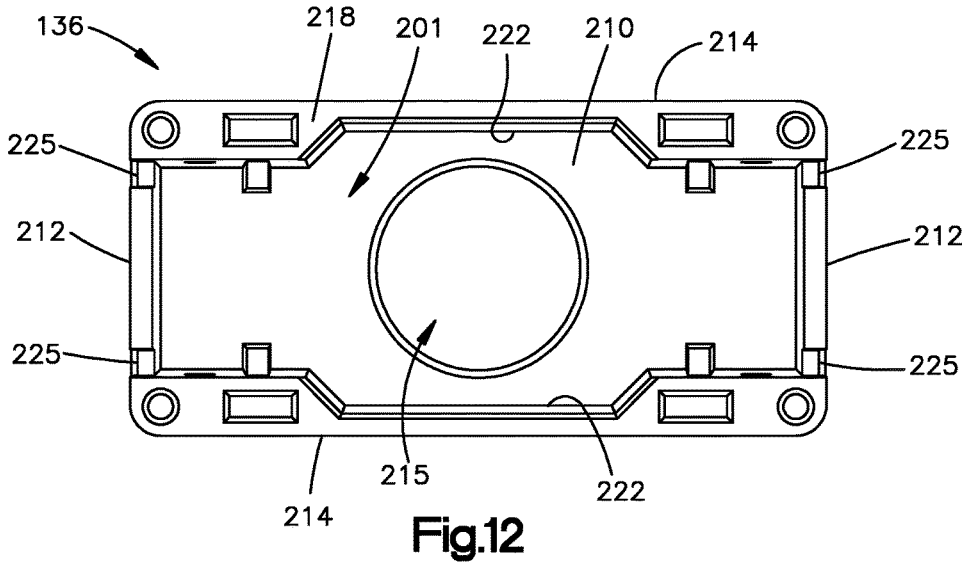
FIG. 12 is a top view of the part shown in FIG. 11.

As shown in FIGS. 11 and 12, the lower housing section 136 has an interior configured as a lower compartment 201. In the given example, the lower housing section 136 is shaped as a rectangular box with a bottom wall 210, a pair of lower end walls 212, and a pair of lower side walls 214. The bottom wall 210 has a wire aperture 215. A nipple 216 (FIG. 5) is installed in the wire aperture 215. The lower end walls 212 and the lower side walls 214 reach fully about the periphery of the lower housing section 136, and together define a peripheral upper edge 218. In this configuration, the lower compartment 201 reaches horizontally between the lower end walls 212 and the lower side walls 214, and reaches vertically from the bottom wall 210 to an open top at the peripheral upper edge 218.

Additional features of the lower housing section 136 are shown in FIG. 12. These include recesses 222 where the lower side walls 214 have a reduced thickness. Also shown in FIG. 12 are end wall slots 225 reaching downward from the peripheral upper edge 218.

Figure 14:
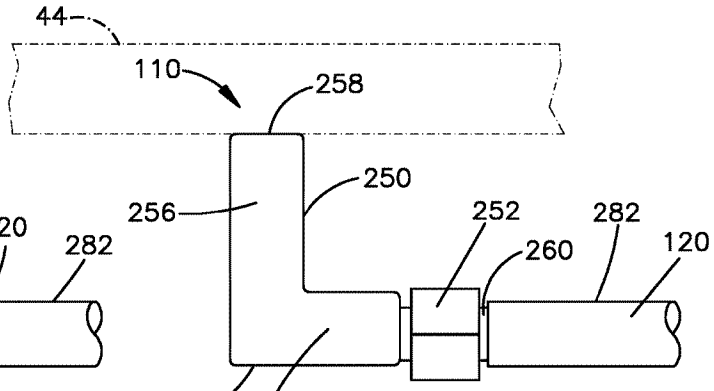
FIG. 14 is a view similar to FIG. 13, showing the parts in a connected condition.
Figure 13:
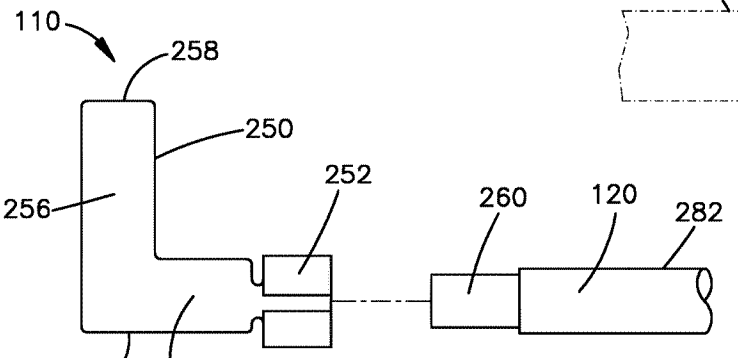
FIG. 13 is a side view of parts that are connected within the fitting.

Referring again to FIGS. 3 and 4, each contactor 110 in the fitting 100 is connected to a respective wire 120. The contactors 110 are preferably alike, with each comprising a single unitary body of metal material including a blade 250 and a connector 252, as shown for example in FIG. 13. The blade 250 is L-shaped with a horizontal base section 254 and a vertical free end section 256. An upper edge 258 of the free end section 256 is configured to make lengthwise contact with a busbar 44 in the strut 12, as indicated in phantom view in FIG. 14. The connector 252 is located at the opposite end of the base section 254 of the blade 250, and is configured for crimping onto an uninsulated section 260 of the wire 120, as shown in FIG. 14. A lower edge 264 of the blade 250 reaches along the base section 254.

When the fitting 100 has the assembled condition of FIGS. 3 and 4, the upper section 134 of the housing is received over the intermediate section 132. The end walls 162 of the upper section 134 adjoin the end walls 152 of the intermediate section 132. The side walls 164 of the upper section 134 adjoin the side walls 150 of the intermediate section 132. The peripheral lower edge 168 of the upper section 134 overlies the base wall 140 on the intermediate section 132. The fins 146 are received within the fin slots 189. Fasteners (not shown) are received through the apertures 149 and bores 191 to secure the two housing sections 132 and 134 together. The upper compartment 159 is thus enclosed securely between the two housing sections 132 and 134.

As further shown in FIG. 3, the intermediate housing section 132 (with the upper section 134 attached) is received downward through the open top of the lower section 136. Stiffeners 270 (FIG. 6) on the intermediate section 132 are received through the end wall slots 225 on the lower section 136 as the intermediate section 132 is moved downward into the lower section 136. The side walls 150 on the intermediate section 132 fit closely within the recesses 222 at the side walls 214 of the lower section 136. Fasteners 274 secure the lower section 136 to the intermediate section 132 so that the lower compartment 201 is enclosed securely between the two housing sections 132 and 136.

The ground terminal 126 reaches into the lower upper compartment 201 through a slot in a side wall 150 of the intermediate housing section 132. A wire 120 is connected to the ground terminal 126 within the lower compartment 201, and reaches outward from the lower compartment 201 through the wire aperture 215 at the bottom of the lower housing section 136.

Figure 15:
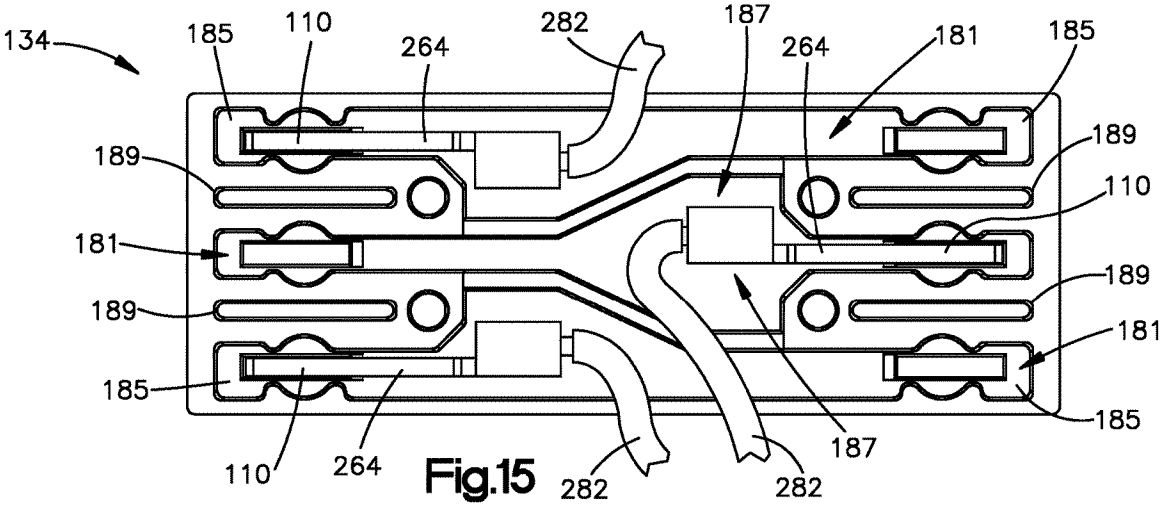
FIG. 15 is a view similar to FIG. 10, showing additional parts of the fitting.

The uninsulated electrical connections at the contactors 110 are contained entirely within the enclosed upper compartment 159. Specifically, the contactors 110 are received within the elongated chambers 181 (FIG. 15) in the upper compartment 159. The free end sections 256 of the blades 250 project outward through the slots 167 in the top wall 160. The lower edges 264 of the blades 250 rest on springs 280 (FIG. 5) that bias the conductors 110 upward. The base sections 254 of the blades 250 reach horizontally into the wider regions 187 of the chambers 181. Those regions 187 provide space for the crimped connectors 252. The base wall 140 of the housing section 130 blocks the crimped connectors 252 from moving downward into the lower compartment 201. However, insulated sections 282 of the wires 120 reach downward from the crimped connectors 252 as shown in FIG. 15. The insulated sections 282 reach outward from the upper compartment 159 into the lower compartment 201 through the wire apertures 145 in the base wall 140. The insulated wire sections 282 reach further downward through the lower compartment 201 and outward through the wire aperture 215 at the bottom of the lower housing section 136.

In the arrangement described above, the housing 130 provides electrical clearance and creepage protection between the contactors 110. This is accomplished in part by the internal walls 180 of the upper housing section 134, and in part by the fins 146 on the intermediate housing section 132.

Specifically, as shown in the view from beneath in FIG. 15, the contactor blades 250 are located within the end regions 185 of the chambers 181. As shown in the upright view of FIG. 16, the springs 280 are located beneath the lower edges 264 of the blades 250. Each spring 180 can potentially conduct electrical current between the respective contactor 110 and the top surface 147 of the base wall 140. Such current could flow across the top surface 147 to an adjacent internal wall 180 of the upper housing section 134. Although the lower edge 192 of the internal wall 180 is received in overlying contract with the upper surface 147 of the base wall 140, the overlying contact provides a seam through which electric current could creep between the adjoining surfaces 192 and 147. For this reason the fin slots 189 are located between the end regions 185 of the chambers 181 as shown in FIG. 15. When the fins 146 are installed in the slots 189 as shown in FIG. 16, they are located directly between a pair of adjacent contactor blades 250.

Figure 16:
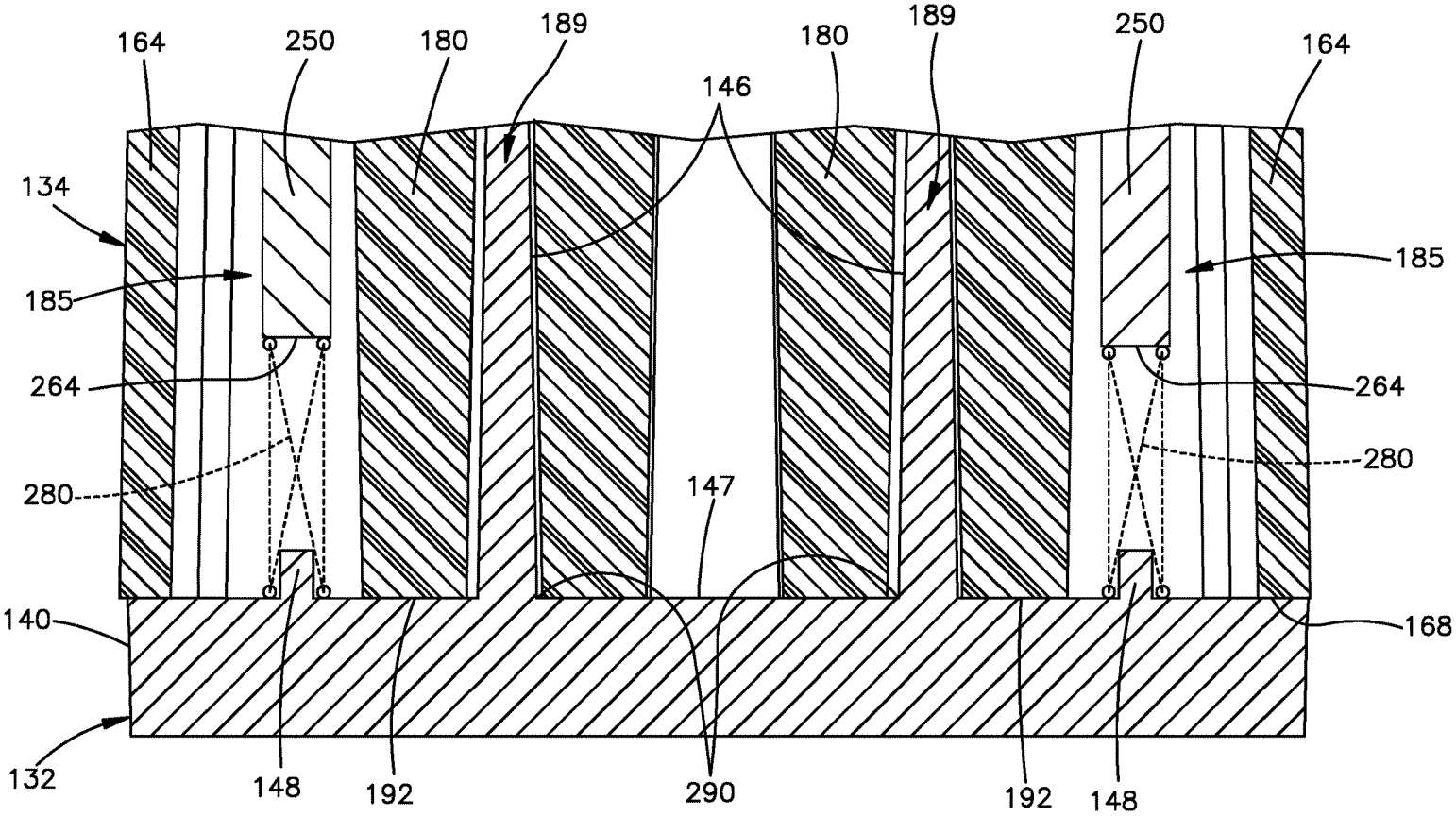
FIG. 16 is a partial sectional view of the fitting.

As further shown in FIG. 16, each fin 146 has a closed juncture 290 with the base wall 140. Each fin 146 thus adjoins the base wall 140 without gaps or seams. The closed junctures 290 at which the fins 146 project upward from the base wall 140 are interposed between the adjacent blades 250. This enables each fin 146 to function as blockage wall that blocks electric current from passing over the base wall 140 directly, i.e. in a straight line, between the adjacent blades 250. If such current should flow between the adjacent blades 250 in a curved or convoluted direction reaching around an intervening fin 146, the increased distance would sufficiently increase the clearance and creepage distances.

This written description sets for the best mode of carrying out the invention, and describes the invention so as to enable a person of ordinary skill in the art to make and use the invention, by presenting examples of the elements recited in the claims. The detailed descriptions of those examples do not impose limitations that are not recited in the claims.

What is claimed is:

1. An apparatus for use with a busway including a strut containing busbars, the apparatus comprising:

an intermediate housing wall having a wire aperture;

an upper housing section having a top wall with contactor slots, and further having an upper compartment enclosed vertically between the top wall and the intermediate housing wall;

a lower housing section having a bottom wall with a wire aperture, and further having a lower compartment enclosed vertically between the bottom wall and the intermediate housing wall;

an electrical contactor having a blade portion projecting outward from the upper compartment through a respective contactor slot to electrically contact with a busbar in the strut; and a wire having an uninsulated section contained entirely within the upper compartment and electrically connected to the contactor within the upper compartment, wherein the wire further has an insulated section reaching outward from the upper compartment into the lower compartment through the wire aperture in the intermediate housing wall, and reaching further outward from the lower compartment through a wire aperture in the bottom wall.

2. An apparatus as defined in claim 1, further comprising a releasable locking mechanism for fixing the apparatus to the strut at a selected location along the busway.

3. An apparatus as defined in claim 1, wherein the contactor has a portion that is crimped directly onto the uninsulated section of the wire within the upper compartment.

4. An apparatus as defined in claim 3, wherein the upper housing section has internal walls dividing the upper compartment into elongated chambers, including a chamber configured to contain the crimped portion of the contactor.

5. An apparatus as defined in claim 1, wherein the upper housing section has a pair of upper side walls reaching between a pair of upper end walls, and the upper compartment is enclosed between the top wall, the upper side walls, the upper end walls, and the intermediate housing wall.

6. An apparatus as defined in claim 5, where in the upper housing section has a continuous peripheral lower edge defined by lower edges of the upper side walls and upper end walls, and the upper housing section abuts the intermediate housing wall fully along the peripheral lower edge.

7. An apparatus as defined in claim 1, wherein the contactor is one of multiple electrical contactors, each of which has a blade portion projecting outward from the upper compartment through a respective contactor slot for electrical contact with a respective busbar in the strut, and the upper housing section has internal walls configured to provide clearance and creepage isolation between the contactors in the upper compartment.

8. An apparatus as defined in claim 1, wherein the lower housing section has a pair of lower side walls reaching between a pair of lower end walls, and the lower compartment is enclosed between the bottom wall, the lower side walls, and the lower end walls.

9. An apparatus for use with a busway including a strut containing busbars, the apparatus comprising:

a housing including a base wall having a wire aperture, a top wall having contactor slots, and a compartment enclosed between the base wall and the top wall;

a wire having an uninsulated section contained entirely within the compartment, and having an insulated section reaching outward from the compartment through the wire aperture in the base wall; and an electrical contactor having a blade section projecting outward from the compartment through a respective contactor slot to electrically contact with a busbar in the strut, and further having a portion that is crimped directly onto the uninsulated section of the wire within the compartment.

10. An apparatus as defined in claim 9, wherein the housing has internal walls dividing the compartment into elongated chambers, including a chamber configured to contain the crimped portion of the contactor.

11. An apparatus as defined in claim 10, wherein the crimped portion of the contactor has a first width, the chamber configured to contain the crimped portion of the contactor has an end region directly beneath the contactor slot, and the end region has a second width less that the first width.

12. An apparatus as defined in claim 9 wherein the contactor is one of multiple electrical contactors, each of which has a blade portion projecting outward from the compartment through a respective contactor slot for electrical contact with a respective busbar in the strut, and the internal walls are configured to provide clearance and creepage isolation between the contactors in the compartment.

13. An apparatus as defined in claim 9, wherein the housing has separate parts including a first part defining the base wall and a second part defining the top wall, the side walls, and the end walls.

14. An apparatus as defined in claim 13, wherein the second part of the housing has a continuous peripheral lower edge defined by lower edges of the side walls and the end walls, and the second part abuts the first part fully about the peripheral lower edge.

15. An apparatus as defined in claim 9, further comprising a releasable locking mechanism for fixing the housing to the strut at a selected location along the busway.

16. An apparatus comprising:

a busway including a strut containing busbars;

a housing including a base wall having a wire aperture, a top wall having contactor slots, and a compartment enclosed between the base wall and the top wall;

a wire having an uninsulated section contained entirely within the compartment, and having an insulated section reaching outward from the compartment through the wire aperture in the base wall;

an electrical contactor having a blade portion projecting outward from the compartment through a respective contactor slot to electrically contact with a busbar in the strut, and further having a portion that is crimped directly onto the uninsulated section of the wire within the compartment; and a releasable locking mechanism for fixing the housing structure to the strut at a selected location along the busway.

17. An apparatus as defined in claim 16, wherein the housing has internal walls dividing the compartment into elongated chambers, including a chamber configured to contain the crimped portion of the contactor.

18. An apparatus as defined in claim 17, wherein the crimped portion of the contactor has a first width, the chamber configured to contain the crimped portion of the contactor has an end region directly beneath the contactor slot, and the end region has a second width less that the first width.

19. An apparatus as defined in claim 16, wherein the contactor is one of multiple electrical contactors, each of which has a blade portion projecting outward from the compartment through a respective contactor slot to electrically contact with a respective busbar in the strut, and the internal walls are configured to provide clearance and creepage isolation between the contactors in the compartment.

20. An apparatus as defined in claim 16, wherein the housing has separate parts including a first part defining the base wall and a second part defining the top wall, the side walls, and the end walls.

21. An apparatus for use with a busway including a strut containing busbars, the apparatus comprising:

a housing having a base wall, a top wall with contactor slots, and a compartment enclosed between the base wall and the top wall;

a pair of adjacent electrical contactor blades, each of which projects outward from the compartment through a respective contactor slot to electrically contact with a respective busbar in the strut, and each of which has a lower edge that reaches over the base wall;

wherein the housing further includes a blockage wall interposed between the adjacent contactor blades, and the blockage wall has a closed juncture with the base wall at a location between the adjacent contactor blades.

22. An apparatus as defined in claim 21, wherein the blockage wall has a free upper end.

23. An apparatus as defined in claim 22, wherein the housing further has an internal wall projecting downward from the top wall toward the base wall at a location between the adjacent contactor blades, a slot is defined within the internal wall, and the blockage wall projects upward into the slot.

24. An apparatus as defined in claim 23, wherein the internal wall has a lower edge in overlying contact with the base wall.

25. An apparatus as defined in claim 24, further comprising a spring biasing a respective one of the adjacent contactor blades upward from the base wall, and wherein the blockage wall is interposed between the spring and an adjacent contactor blade.

26. An apparatus as defined in claim 25 wherein the spring is mounted on the base wall.

* * * * *